US009239202B2

(12) United States Patent
Michal et al.

(10) Patent No.: US 9,239,202 B2
(45) Date of Patent: Jan. 19, 2016

(54) FIREARM BARREL SLEEVES AND BARREL GRIPS

(71) Applicants: Frank Michal, Medina, OH (US); Michael E. Stein, New Philadelphia, OH (US)

(72) Inventors: Frank Michal, Medina, OH (US); Michael E. Stein, New Philadelphia, OH (US)

( * ) Notice: Subject to any disclaimer, the term of this patent is extended or adjusted under 35 U.S.C. 154(b) by 0 days.

(21) Appl. No.: 14/494,083

(22) Filed: Sep. 23, 2014

(65) Prior Publication Data

US 2015/0082679 A1 Mar. 26, 2015

Related U.S. Application Data

(60) Provisional application No. 61/881,144, filed on Sep. 23, 2013.

(51) Int. Cl.

| | |
|---|---|
| ***F41A 13/00*** | (2006.01) |
| ***F41A 21/44*** | (2006.01) |
| ***F41C 23/16*** | (2006.01) |
| ***F41A 21/24*** | (2006.01) |

(52) U.S. Cl.

CPC ..... *F41A 21/44* (2013.01); *F41A 21/24* (2013.01); *F41C 23/16* (2013.01)

(58) Field of Classification Search

CPC ..... F41A 21/36; F41A 1/08
USPC ..... 89/14.1–16
See application file for complete search history.

(56) References Cited

U.S. PATENT DOCUMENTS

| | | | | |
|---|---|---|---|---|
| 1,434,044 | A * | 10/1922 | Cooke | 89/1.702 |
| 1,494,524 | A * | 5/1924 | Adamson | 89/16 |
| 2,658,298 | A * | 11/1953 | Oberfell | 42/79 |
| 2,667,815 | A * | 2/1954 | Strong | 89/14.3 |
| 2,700,839 | A * | 2/1955 | Finlay et al. | 42/79 |
| 2,780,019 | A * | 2/1957 | Sullivan | 42/76.02 |
| 2,953,972 | A * | 9/1960 | Sorensen | 89/14.3 |
| 4,536,982 | A * | 8/1985 | Bredbury et al. | 42/71.01 |
| 4,663,875 | A * | 5/1987 | Tatro | 42/71.01 |
| 6,945,154 | B1 * | 9/2005 | Luth | 89/14.1 |
| 8,091,265 | B1 * | 1/2012 | Teetzel et al. | 42/72 |
| 8,104,394 | B2 * | 1/2012 | Meyers | 89/14.2 |
| 8,464,457 | B2 * | 6/2013 | Troy et al. | 42/71.01 |
| 2003/0154849 | A1 * | 8/2003 | Breuer | 89/14.3 |
| 2011/0192066 | A1 * | 8/2011 | Kimmel et al. | 42/71.01 |
| 2011/0247254 | A1 * | 10/2011 | Barnes | 42/71.01 |
| 2012/0125184 | A1 * | 5/2012 | Meyers | 89/14.2 |
| 2012/0186123 | A1 * | 7/2012 | Troy et al. | 42/71.01 |

* cited by examiner

*Primary Examiner* — Samir Abdosh

(74) *Attorney, Agent, or Firm* — Black McCuskey Souers & Arbaugh, LPA

(57) ABSTRACT

Firearm barrel sleeves and barrel grips configured to fit upon gun barrels are made of heat insulating material and have internal splines and externals ribs or flanges which extend from a cylindrical body and provide gripping function, heat transfer and air flow.

14 Claims, 4 Drawing Sheets

FIREARM BARREL SLEEVES AND BARREL GRIPS

RELATED APPLICATIONS

This application claims benefit of U.S. Provisional Application No. 61/881,144 filed on Sep. 23, 2013.

FIELD OF THE INVENTION

The present disclosure and related inventions is in the general field of firearms and firearm accessories.

BACKGROUND OF THE INVENTION

Firearm barrels absorb a large amount of heat from firing action, further increased by repeated firing particularly in semi and fully automatic weapons. Barrel heat along the entire length reaches temperatures at which skin or other materials are quickly burned on contact. High heat accumulation occurs even with barrel ventilation openings. In longer length weapons such as military machine guns, the extended length barrel provides a gripping point during firing, but the barrel temperature is too high for direct hand contact.

SUMMARY OF THE INVENTION

The present disclosure and related inventions provides novel covers and grips adapted for use with a firearm and specifically configured for engagement with a barrel of a firearm, including such firearm weapons as carbines and machine guns. In accordance with the disclosure, a firearm barrel sleeve has a generally cylindrical body having a first end and a second end; an internal bore configured to receive and fit about an exterior of a gun barrel; a plurality of radially arrayed splines which project from an interior surface of the internal bore and extend in a direction parallel to a longitudinal axis of the generally cylindrical body; a plurality of ribs which project from an exterior of the generally cylindrical body, the ribs arranged at an angle relative to the splines. Air passageways between the barrel sleeve and a gun barrel are created by the splines to allow air flow between the gun barrel and the barrel sleeve. Contact of the splines with the barrel secures the sleeve in position on the barrel. Heat absorbed by the sleeve from the barrel is dissipated through the body of the sleeve and by the exterior flanges.

These and other features and aspects of the present disclosure and corresponding inventions are further described herein with reference to the accompanying drawing illustrations.

DESCRIPTION OF THE DRAWING FIGURES

DETAILED DESCRIPTION OF THE PREFERRED AND ALTERNATE EMBODIMENTS

Figure 1:
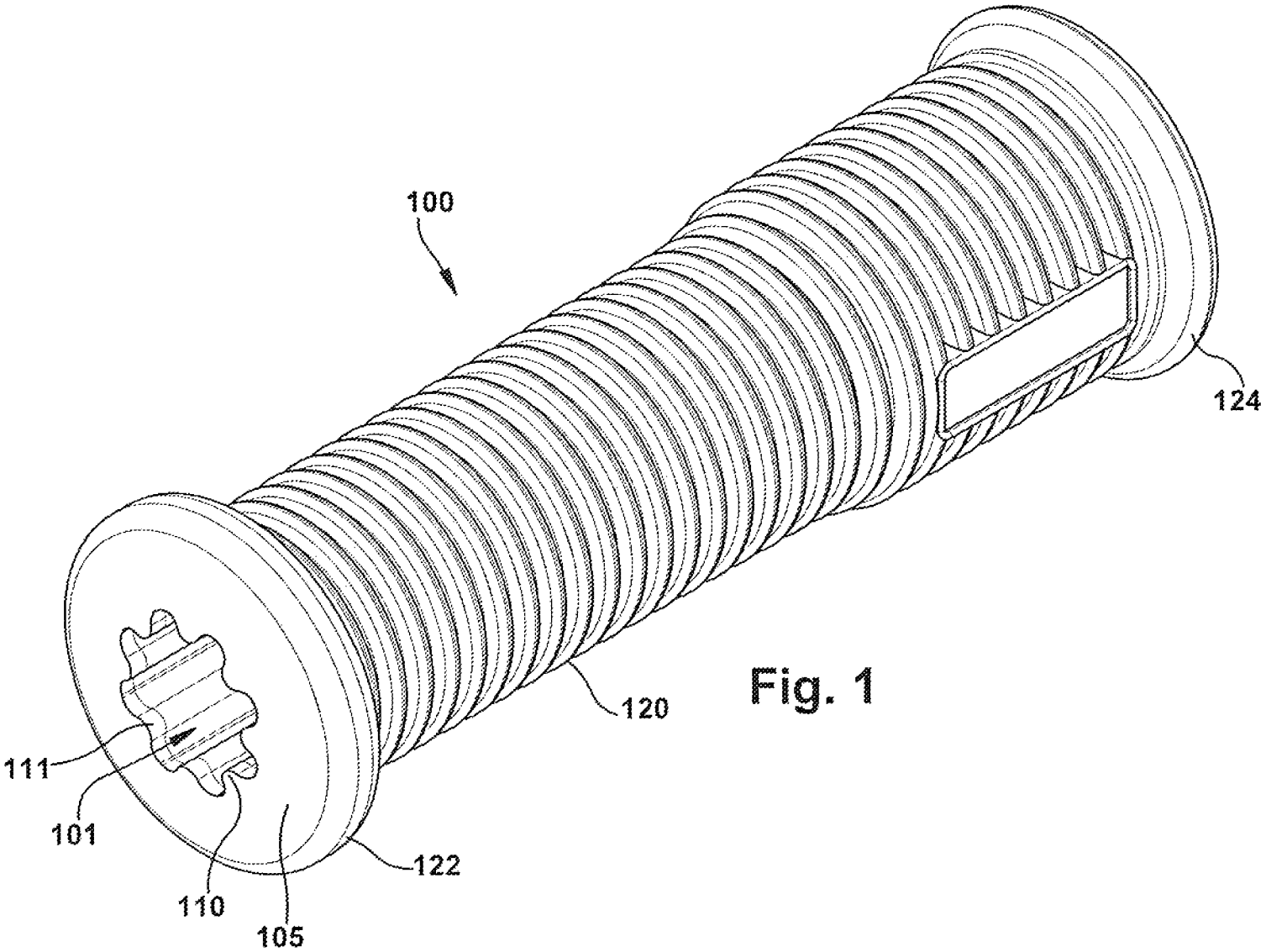
FIG. 1 is a perspective view of a representative embodiment of a firearm barrel sleeve of the present disclosure.
Figure 2:
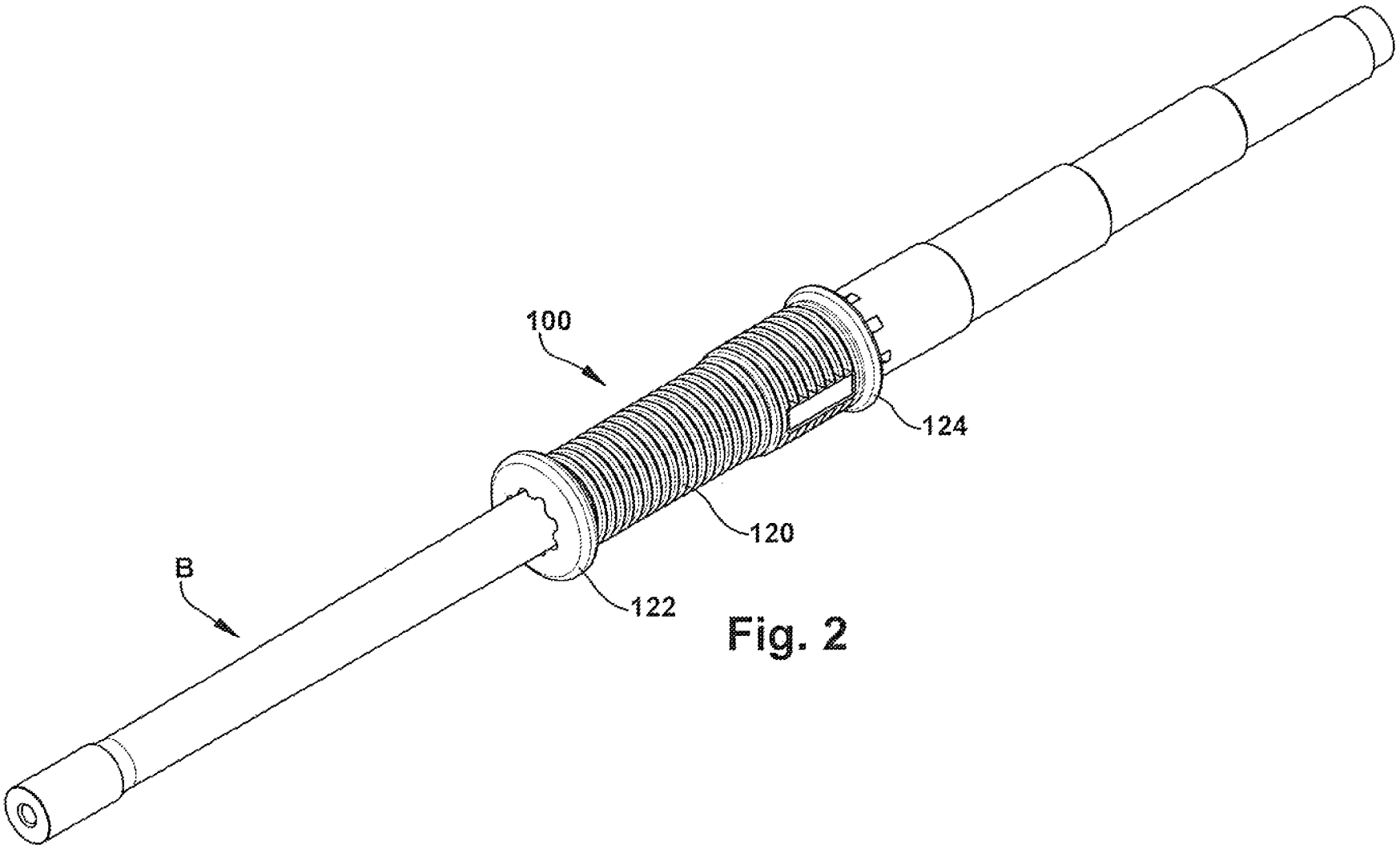
FIG. 2 is a perspective view of the firearm barrel sleeve installed on a barrel of a gun.
Figure 3:
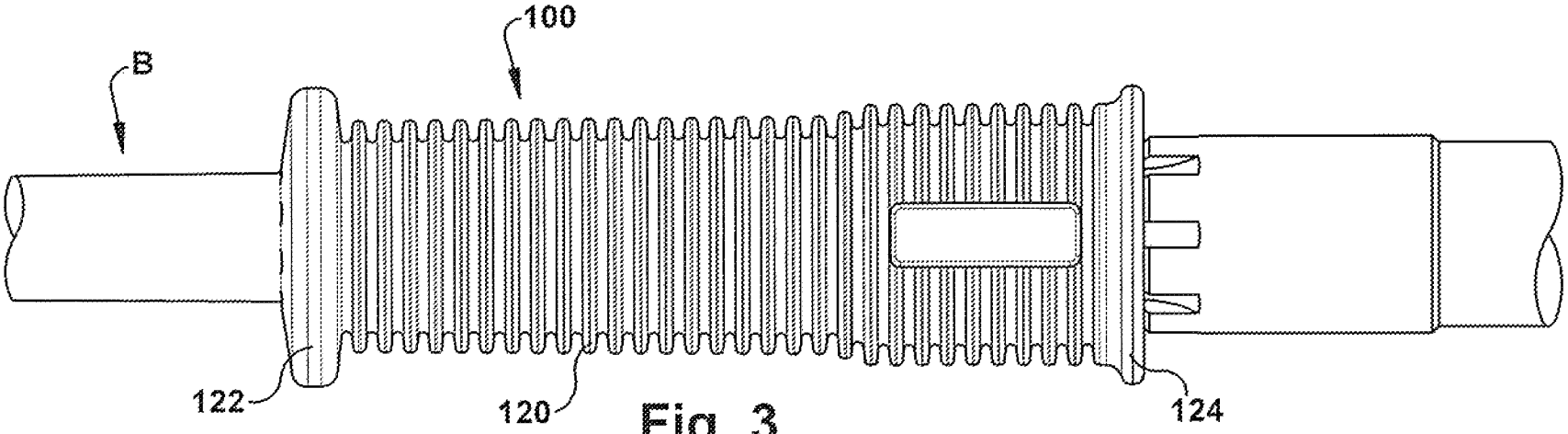
FIG. 3 is a profile view of the firearm barrel sleeve of FIG. 1.
Figure 4:
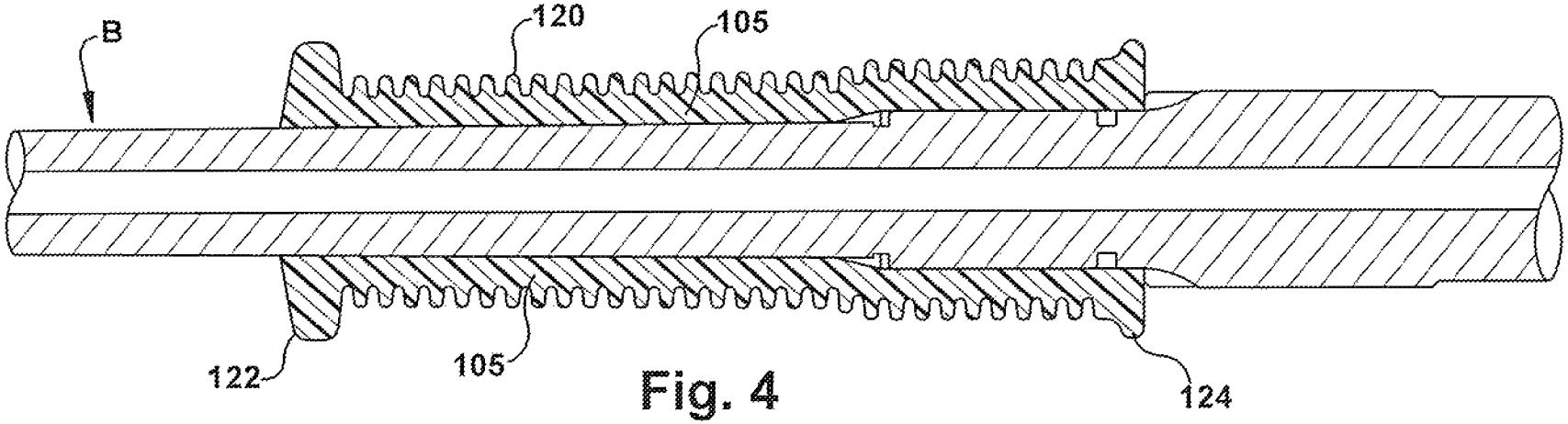
FIG. 4 is a cross-sectional view of the firearm barrel sleeve of FIG. 3.
Figure 6:
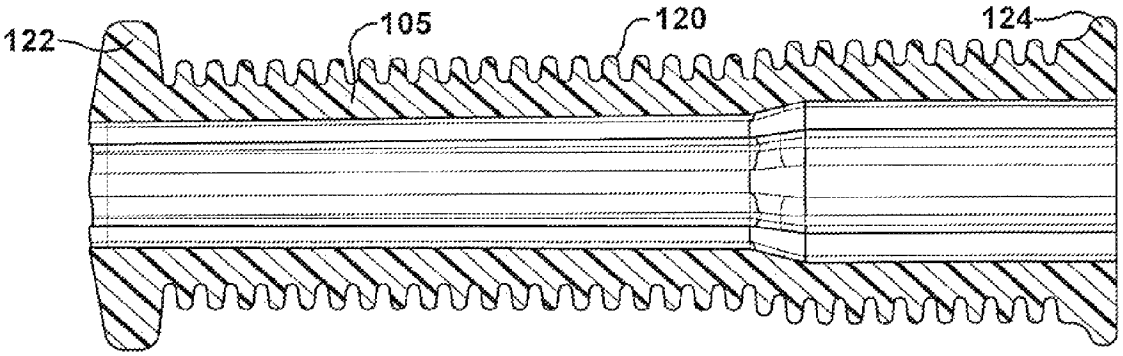
FIG. 6 is a cross-sectional view of a firearm barrel sleeve of the present disclosure.
Figure 5:
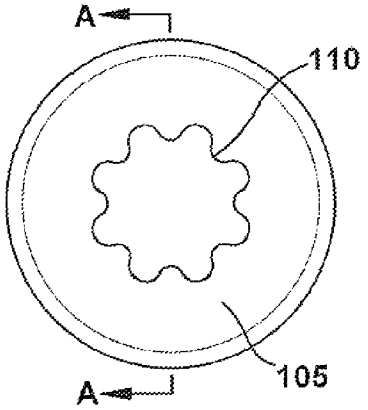
FIG. 5 is an end view of a firearm barrel sleeve of the present disclosure.
Figure 7:
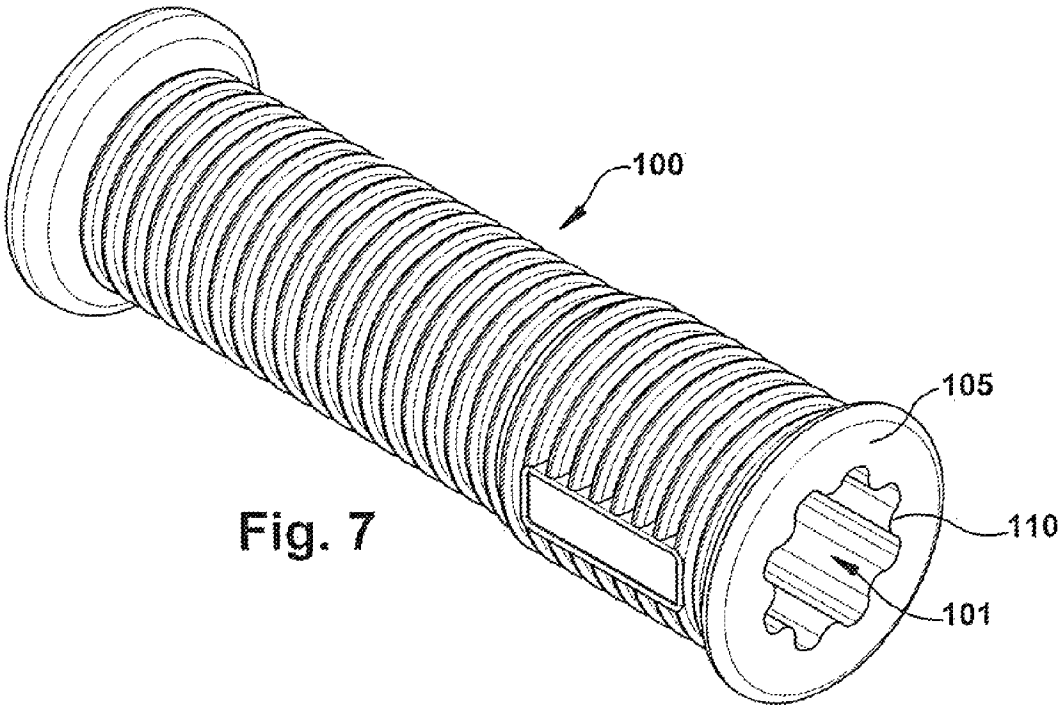
FIG. 7 is a perspective view of a firearm barrel sleeve of the present disclosure.

As illustrated in FIGS. 1-7, a representative embodiment of a firearm barrel grip or barrel sleeve of the present disclosure, indicated generally at 100, is in the form of a generally cylindrical component which has an internal bore 101 configured to fit closely against the exterior surface of a gun barrel, such as for example a cylindrical form gun barrel B, such as for example the M2 or Browning .50 caliber machine guns. The internal bore 101 may include or more internal diameters as shown to accommodate and fit with different gun barrel configurations. The internal bore 101 also preferably has a profile that includes one or more splines or ridges 110 that run longitudinally, parallel to the longitudinal axis of the barrel grip 100. An apex 111 of each spline 110 is dimensioned and formed to contact the exterior surface of a firearm barrel throughout the length of the barrel grip 100. The radial array of the splines 110 and particularly the apex 111 of each spline 110 defines a radial array of multiple areas of contact with the exterior of the gun barrel B, with air passages through the internal bore 101 between each spline 110 along the entire length of the barrel sleeve 100. This allows air flow along a substantial length of the barrel B which is covered by the barrel sleeve 100 even while that length segment of the barrel B is covered and protected from heat radiation which would otherwise prevent gripping of the barrel B.

An exterior surface of the barrel grip 100 is configured with a plurality of ribs 120 disposed radially about the generally cylindrical form of the barrel grip 100, and perpendicular to the interior ridges 110 in the internal bore 101. The ribs 120 project radially outward from the generally cylindrical body 105 of the barrel grip 100, as shown, and provide a gripping surface on substantially the entire exterior of the barrel grip 100. Additional exterior features which can be incorporated into the barrel grip 100 are ends or collars 122 and 124 which also project radially from the cylindrical body and can project an extent greater than the ribs 120, and each provide tactile locators for hand placement on the barrel grip 100. One or both of ends 122, 124 may alternatively be in the form of a locking collar with integral or external compression device operative to apply greater pressure to the barrel exterior in order to more tightly secure the sleeve 100 to the barrel. Alternatively, the ribs 120 may be in other geometric forms, or other configurations of contouring or profiles or projections may be formed to extend from the exterior surface of the barrel grip 100. Preferably, the ribs project or extend from the exterior surface of the generally cylindrical body 105 an extent which is less than a thickness dimension of the generally cylindrical body 105. However, ribs or flanges which extend to a greater extent than a thickness dimension of the generally cylindrical body 105 can also be embodied. Also as illustrated the body 105 may have a contoured exterior surface with different thicknesses or radial extents from the barrel B, which contours may be followed by the ribs 120.

The barrel sleeves 100 of the disclosure are preferably molded of a polymeric material and preferably an elastic polymer or "elastomer" and thermoplastic elastomers which exhibit viscoelasticity in durometers in the approximate hardness ranges of, for example 5 Shore A to 90 Shore A, 40 Shore A or lower and up to 80 Shore A, and a more preferred range of 40 Shore A to 70 Shore A, and an even more preferred range of 50 Shore A to 70 Shore A, and an even more preferred range of 35 Shore A to 60 Shore A. Such materials include, for example, one or more of the following: synthetic rubber, natural rubber, neoprene, butyl rubber, silicone, urethane, viscoelastic urethane, nylon, PVC, polyethylene, polystyrene, polypropylene, PVB, PVDF or Nanbrol®, a nano-particle reinforced nitrile butadiene rubber (NBR), and thermoplastic polymer alloys with SBR, EPDM or urethanes as base polymers and blended to optimize dynamic properties, dimensional stability and elasticity, thermal resistance and fatigue performance. Additives which can be used with these materials in the manufacture of the described gun rail attachments include glass beads, Expandacel™, Kevlar™, Mylar™, fiberglass, cotton or other woven or non-woven materials in internal layers with the gun rail attachment bodies. Additives or coatings (such as, for example, Nomex™ or Nitrile™) can be selectively incorporated into the gun rail attachment body material or design for improved heat resistance, durability, strength, tackiness or surface friction, or any other desired properties.

The use of thermoplastic polymers in these hardness ranges for the barrel sleeves 100, gun rail attachments and other firearm components which attach to or fit with various firearms provides numerous advantages, such as a far superior gripping structure and feel than the relatively much harder rail cover attachments of the prior art, heat guarding for the operator, and shock absorption and damage protection for the weapon. The use of visco-elastic materials in the disclosed hardness ratings provides numerous advantages over the much harder plastic rail covers of the prior art. The barrel sleeves 100 provide a gripping structure and surface which can be squeezed as a relatively soft grip over the steel gun rail, dramatically improving the secure handling of a gun by the barrel, shock and recoil absorption, vibration dampening—including automatic or semi-automatic fire recoil and recoil vibration, resistance to moisture and grease, a high friction gripping surface even when wet, temperature insulation, reduction of infra-red signature and mirage effect, sound insulation and noise reduction and cushioning, an improved mounting surface for the gun barrel, protection against operator burns, damage protection for the gun, and other advantages and benefits as further described herein. A preferred material compound resists extreme heat and cold temperature fluctuations and will maintain its flexibility and tactile feel in a wide range of environments.

The invention claimed is:

1. A gun barrel cover comprising:

a generally cylindrical body having a length, a first end and a second end;

an internal bore configured to receive and fit about an exterior of a gun barrel;

a plurality of radially arrayed splines which project from an interior surface of the internal bore and extend in a direction parallel to a longituidinal axis of the generally cylindrical body, the splines having an apex dimensioned and formed to contact the exterior surface of the gun barrel throughout the length of the body;

a plurality of ribs which project from an exterior of the generally cylindrical body, the ribs arranged at an angle relative to the splines.

2. The gun barrel cover of claim 1 wherein the plurality of ribs are generally orthogonal to the plurality of splines.

3. The gun barrel cover of claim 1 wherein the generally cylindrical body has a generally uniform cross-sectional thickness.

4. The gun barrel cover of claim 1 wherein the plurality of ribs are generally uniformly spaced along a length of the generally cylindrical body between the first end and the second end of the cylindrical body.

5. The gun barrel cover of claim 1 wherein the plurality of ribs project from the generally cylindrical body a generally uniform extent.

6. The gun barrel cover of claim 1 wherein the plurality of ribs project from the generally cylindrical body a distance generally less than a thickness dimension of the generally cylindrical body.

7. The gun barrel cover of claim 1 further comprising a collar at a first end of the generally cylindrical body.

8. The gun barrel cover of claim 1 wherein the splines project from the internal surface of the internal bore to an extent which defines a contact radius for contact with a gun barrel surface.

9. The gun barrel cover of claim 1, wherein air passages are formed along the length of the body between splines.

10. The gun barrel cover of claim 1, wherein the gun barrel cover is molded of a polymeric material.

11. The gun barrel cover of claim 1, wherein the gun barrel cover is molded of an elastic polymer.

12. The gun barrel cover of claim 11, wherein the elastic polymer has a hardness range between 5 Shore A to 90 Shore A.

13. The gun barrel cover of claim 11, wherein the elastic polymer has a hardness range between 40 Shore A to 70 Shore A.

14. The gun barrel cover of claim 11, wherein the elastic polymer has a hardness range between 35 Shore A to 60 Shore A.

* * * * *